United States Patent [19]

Spaulding

[11] 3,977,155

[45] Aug. 31, 1976

[54] BATT STACKER/LOADER

[75] Inventor: Harold E. Spaulding, Audubon, Pa.

[73] Assignee: Certain-teed Corporation, Valley Forge, Pa.

[22] Filed: Nov. 12, 1975

[21] Appl. No.: 631,014

[52] U.S. Cl. ..... 53/59 R; 53/124 D; 53/124 TS; 100/49; 100/215; 100/226; 100/242

[51] Int. Cl.[2] ..... B65B 63/02; B30B 1/24; B30B 9/30

[58] Field of Search ..... 53/124 D, 124 E, 124 TS, 53/124 R, 159, 162, 59 R; 100/215, 226, 242, 49

[56] References Cited

UNITED STATES PATENTS

| | | | |
|---|---|---|---|
| 2,646,745 | 7/1953 | Seltzer | 100/49 UX |
| 3,695,172 | 10/1972 | Cleary et al. | 100/49 X |
| 3,721,060 | 3/1973 | Quinto | 100/215 X |
| 3,908,539 | 9/1975 | O'Brien | 53/124 D X |

*Primary Examiner*—Travis S. McGehee
*Assistant Examiner*—Horace M. Culver
*Attorney, Agent, or Firm*—Paul & Paul

[57] ABSTRACT

Apparatus automatically stacks and compresses a preselected number of batts of compressible material, such as fiberglass insulation, and then loads each compressed stack of batts into a sleeve wrapper or bag. When the apparatus is started up it is preferable to initially accumulate a stack of batts in the apparatus prior to changing the apparatus to an automatic mode of operation.

18 Claims, 16 Drawing Figures

55
155
61
68
154
69
54

90
91
155
55
51
14
46
31
45
41
46
12
41
16
44
31
73
54
154
50
73
42
36
4
4
38
43
35
74
D
36
30
31
54
154
66
55
60
14
46
45
41
46
12
41
87
155
97
95
92
93
61
64
154
155
66
71
68
70
69
54

BATT STACKER/LOADER

BACKGROUND OF THE INVENTION

The present invention relates to apparatus for packaging batts of compressible material, such as fiberglass insulation.

It is known in the prior art to produce a continuous length of fiberglass insulation material and to cut the continuous length into batts.

To conserve shipping space, it is advantageous to stack a predetermined number of batts and to compress the stack for insertion into a sleeve wrapper or bag.

SUMMARY OF THE INVENTION

A principal object of the present invention is to provide apparatus for receiving a continuous supply of batts of fiberglass insulation, or other compressible material, for stacking automatically a preselected number of batts, for compressing automatically the stack of batts, and for loading the compressed stacks into sleeve wrappers or bags.

A further obejc is to provide automatic stacking and loading. machinery which is adjustable to batts of different widths.

These and other objects and advantages of the present invention will become clear from a reading of the following description of a preferred embodiment thereof.

DETAILED DESCRIPTION OF THE PREFERRED EMBODIMENTS

The function of the apparatus of the present invention is to receive, one at a time, a continuous supply of batts of compressible insulation material, such as fiberglass, stack them vertically, compress the stack of batts, and insert the compressed stack of batts into a sleeve wrapper or a bag.

Figure 2:
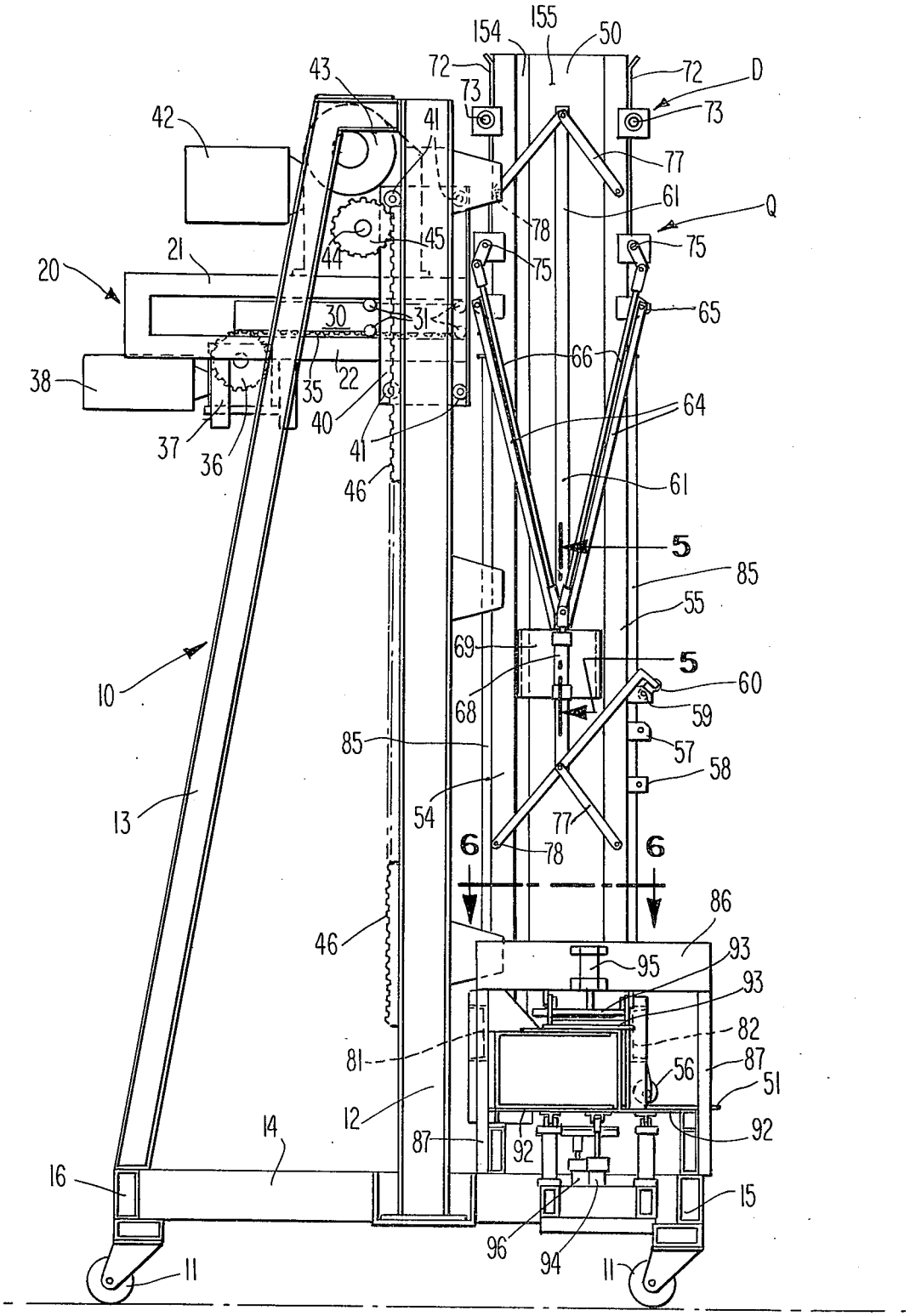
FIG. 2 is a side elevational view of the apparatus of FIG. 1
Figure 3:
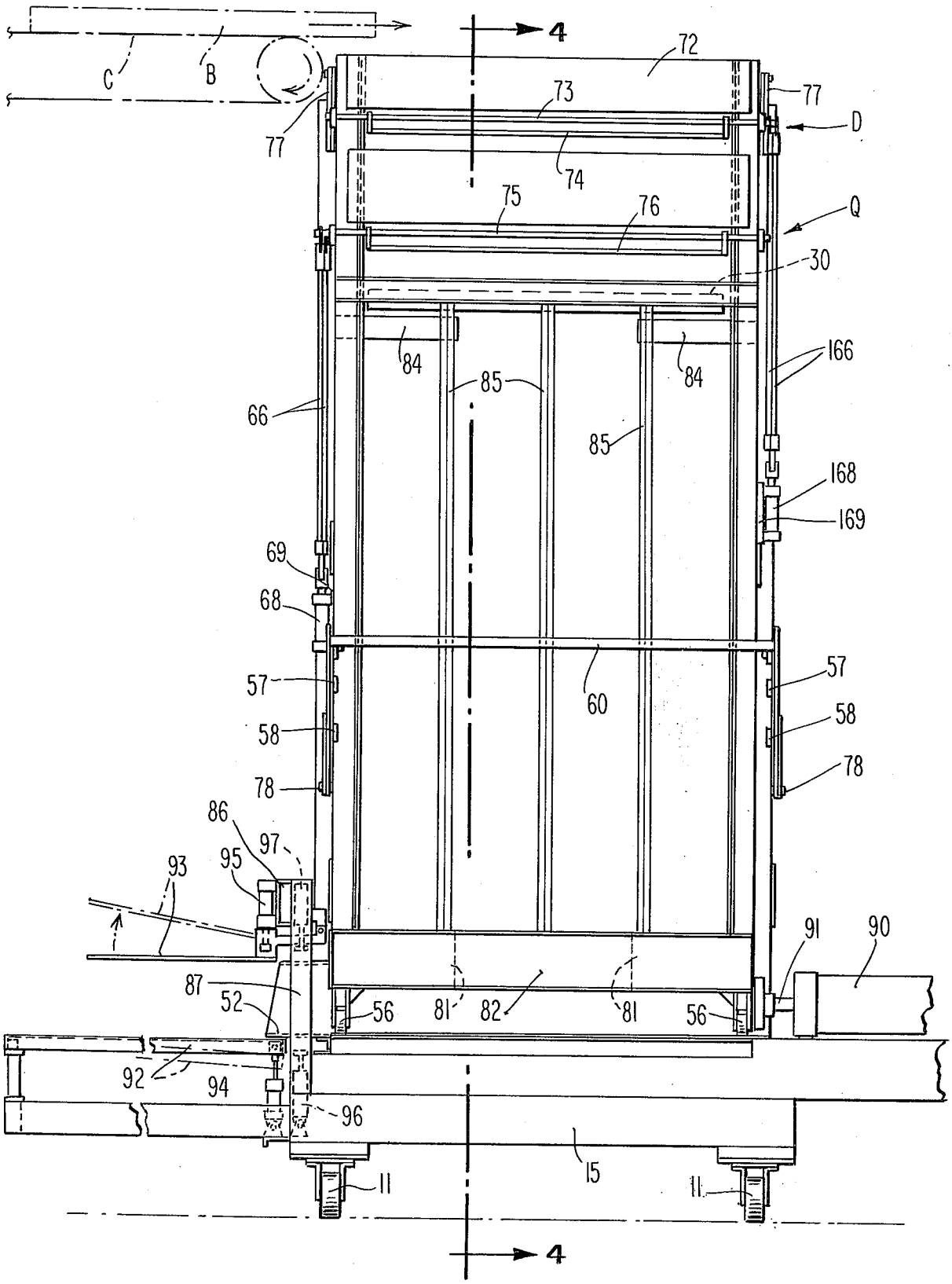
FIG. 3 is an end elevational view of the apparatus of FIGS. 1 and 2.
Figure 4:
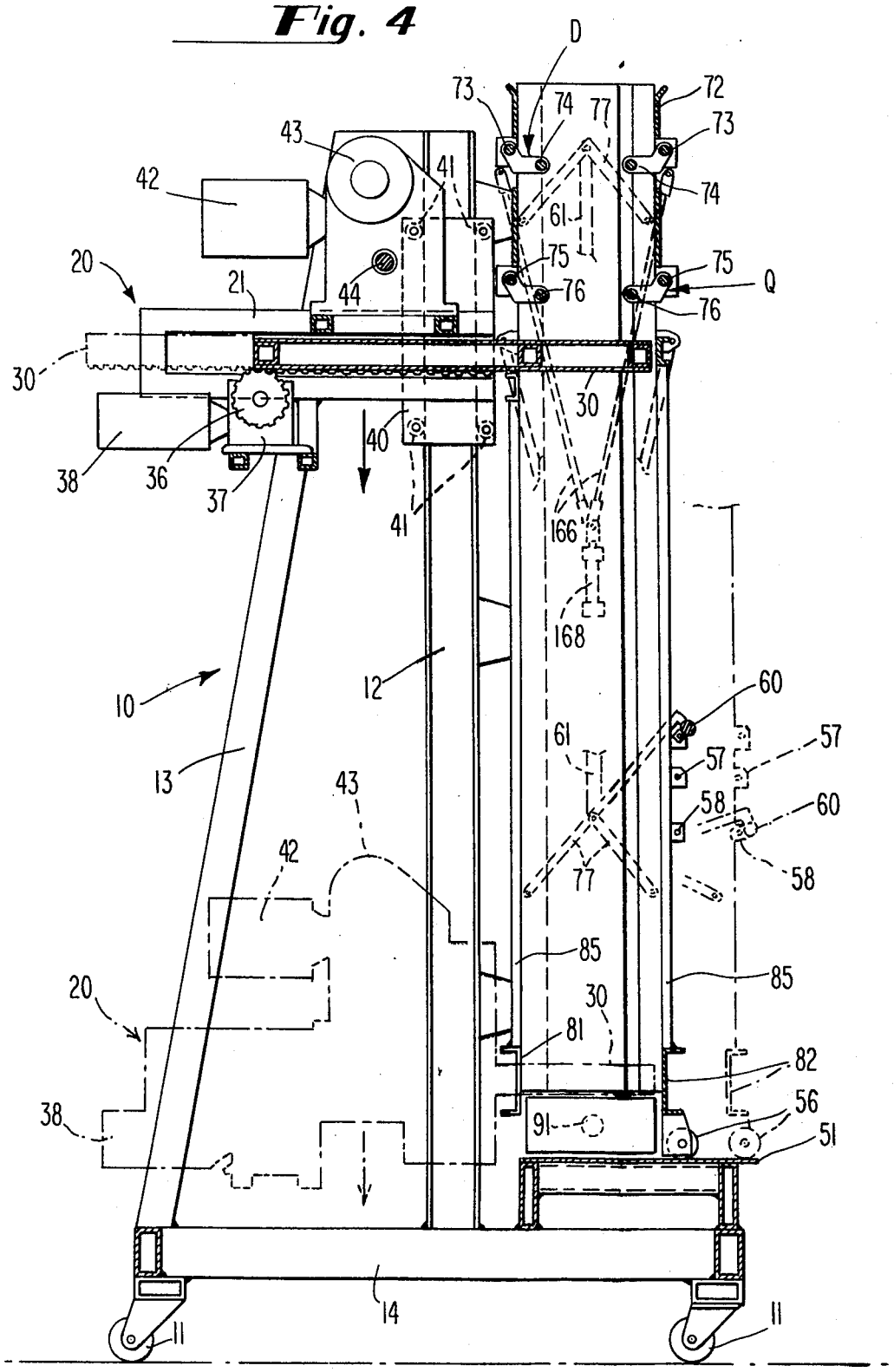
FIG. 4 is a view, in section, looking along the lines 4—4 of FIG. 1 and 4—4 of FIG. 3.
Figure 7:
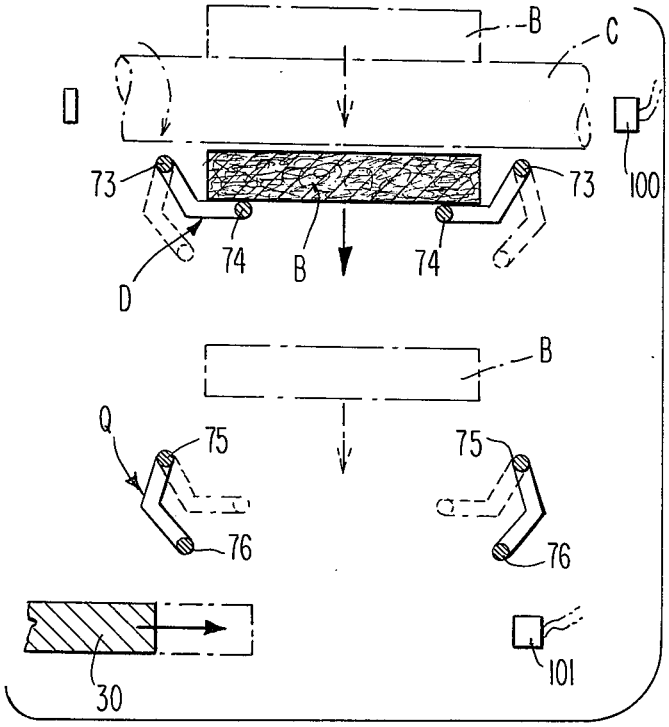
FIGS. 7, 8, 9, and 10 are a series of schematic views illustrating the action of the drop gate and queue gate during the operation of the apparatus of the present invention.

Referring now to the drawings, batts B, shown in phantom in FIGS. 3 and 7, are being delivered by the conveyor C, one at a time, to the upper end of a hollow vertical shaft 50, best seen in FIGS. 2 and 4. As each batt is delivered successively to the shaft 50 it is caught and supported by a pair of arms or bars 74 of a drop gate D, as illustrated shematically in FIG. 7. This is sensed by photo-cell 100, which then functions to open the gate D, i.e. the pairs of bars 74 are pivoted downwardly and outwardly about pivot bars 73 to the phantom position shown in FIG. 7. When this happens, the batt drops downwardly. If the queu gate Q is closed, i.e, if the pair of bars 76 are in the inward position shown in phantom in FIG. 7, the batt is caught and supported by the bars 76. If the queue gate Q is open, i.e., if the pair of bars 76 are in the downward-and-outward position shown in solid line in FIG. 7, the batt drops through the gate Q.

At start-up, the gate Q remains open, i.e., the pair of bars 76 remain in their outward position, shown in solid line in FIG. 7. At this time, the platen 30 is in its retracted position, shown in solid line in FIG. 7 and, accordingly, each batt drops all the way down the vertical shaft 50 to the bottom plate 51 thereof. See FIG. 12. The start-up condition continues until the desired number of batts for forming one package has been accumulated on the bottom plate 51 of the vertical shaft 50. At this point the apparatus may be changed to an automatic mode of operation.

Figure 8:
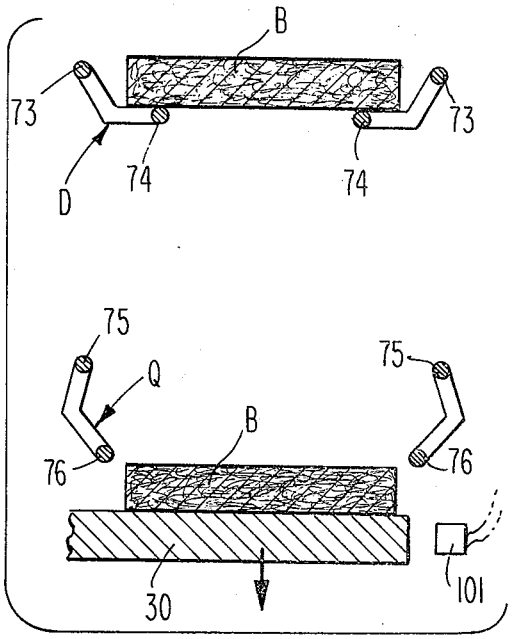

When the apparatus is in automatic operation and the counter indicates that the desired number of batts have been accumulated, the platen 30, best seen in FIG. 4, is moved laterally outwardly from its retracted position, shown in solid line in FIG. 7, into and across the vertical shaft 50 to the extended position shown in FIG. 8. Lateral movement of platen 30 is effected by motor 38 which drives, through gear box 37, a pair of rack gears 36, seen in FIGS. 1, 2 and 4. Rack gears 36 engage a pair of racks 35 which are secured to the underside of platen 30. Rollers 31 support platen 30.

Figure 9:
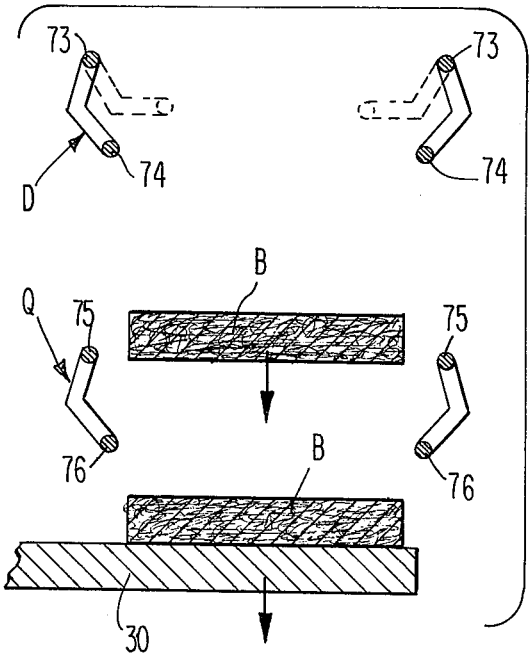
Figure 10:
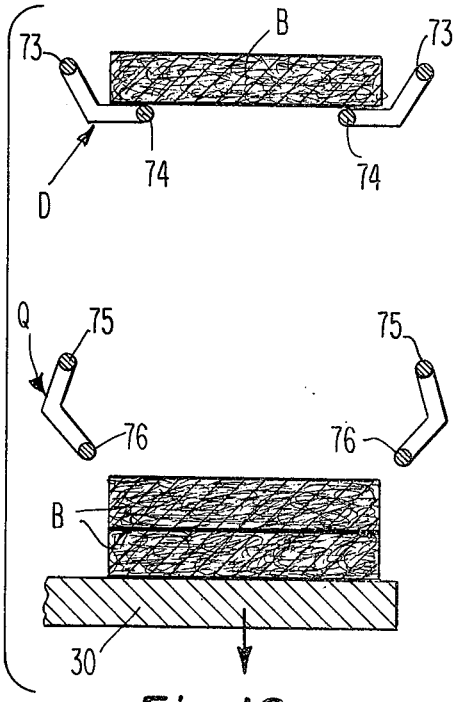
Figure 11:
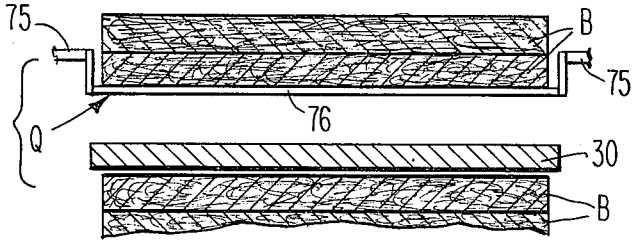
FIGS. 11, 12, 13, 14, 15 and 16 are a series of schematic views illustrating the manner in which batts are stacked, compressed, and packaged by the automatic apparatus of the present invention.

When platen 30 is in its extended position as each batt B is caught by gate D, it is sensed and counted by means including photocell 100. The gate D is opened and each batt is dropped, one at a time, by drop gate D. The batt passes through the open gate Q and is caught by and stacked on the platen 30. This is illustrated in FIGS. 8, 9 and 10. During this action, platen 30 is descending down the shaft 50 as indicated in FIGS. 8, 9 and 10. A proximity switch 101, seen in FIG. 8, senses when platen 30 reaches the desired limit of its horizontal movement and actuates motor 42 to cause a T-shaped carriage 20 to descend, carrying down with it the platen 30.

In the apparatus as illustrated platen 30 moves downward at a rate approximately twice as fast as the height of the batt column stacking up on it increases. Thus, the downward motion of platen 30 is completed before approximately half the batt count is reached. While the remaining part of the batt count is being completed, the platen 30 performs a halt form compressed batt extraction, completion of downward movement, withdrawal for recovery, and recovery up. This action continues until the predetermined number of batts B required to make one bundle or package is sensed, by means including photo-cell 100, as having been dropped by gate D an accumulated in stacked formation on platen 30. The gate Q is the moved to its closed position, illustrated in phantom in FIG. 7.

Figures 1, 5, 6:
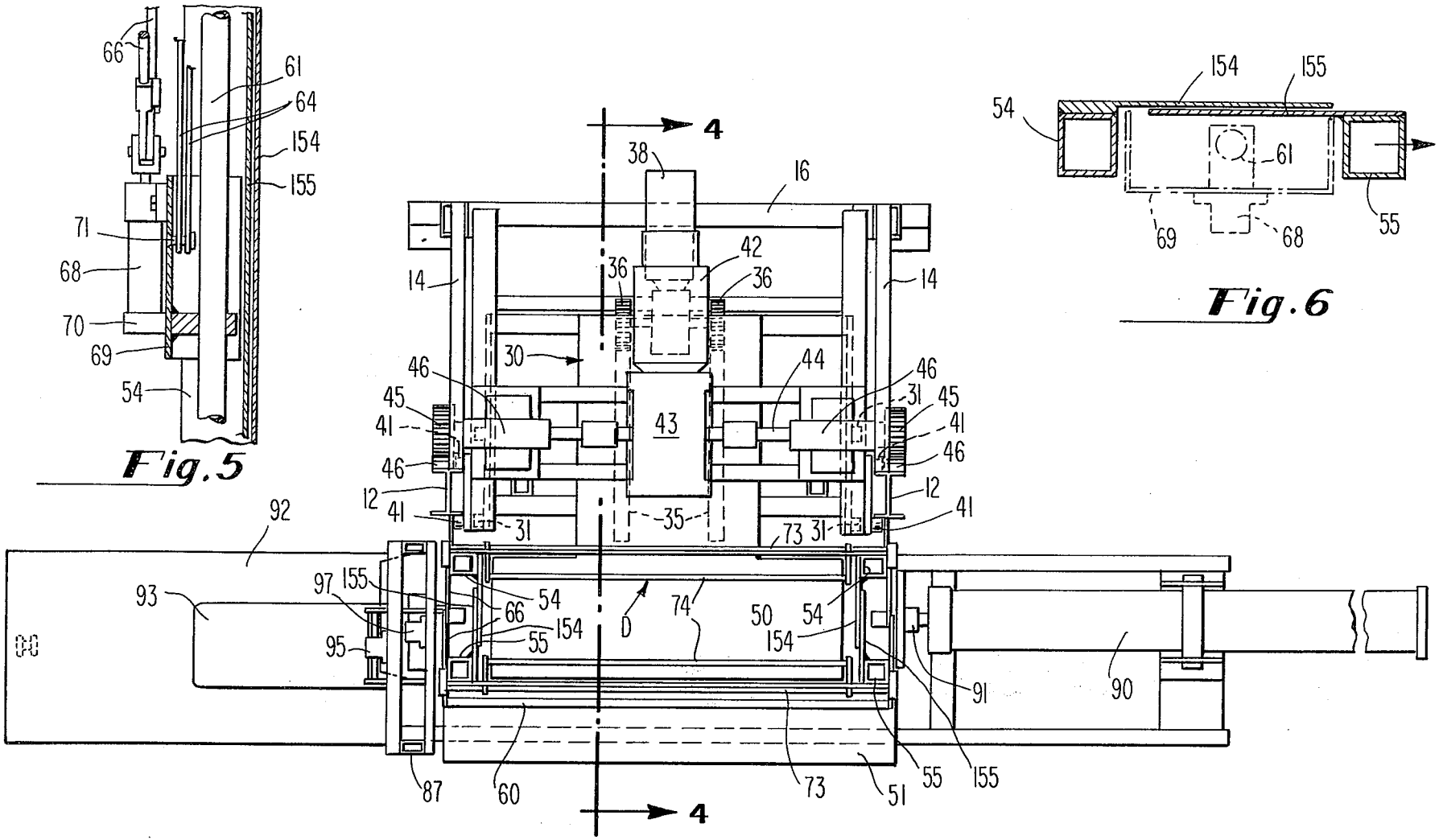
FIG. 1 is a plan view of automatic batt stacker/loader apparatus according to the present invention.
FIG. 5 is a detailed view looking along the line 5—5 of FIG. 2.
FIG. 6 is a detailed view looking down along the line 6—6 of FIG. 2.

As seen best in FIGS. 1, 2 and 4, the descent of platen 30, in its extended position, is controlled by the lift and descent motor 42 which drives, through box 43 and axle 44 journalled in pillow blocks, a pair of rack gears 45. Gears 45 cooperate with a pair of vertical racks 46 to cause the carriage 20 to descend. This descent is guided by a pair of side plates 40 each carrying four guide rollers 41.

Figure 12:
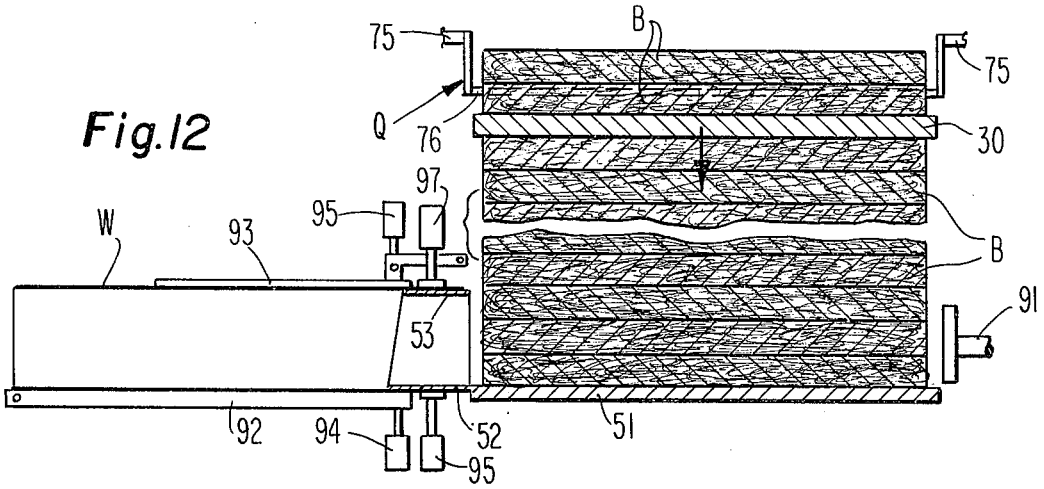

It will be recalled that at start-up the preselected number of batts to form one initial package were dropped to the bottom 51 of the vertical shaft 50. Thus, when, as just described, platen 30 carrying batts as illustrated in FIG. 10 is carried down by the descent of the carriage 20, the undersurface of platen 30 comes into engagement with the upper surface of the top-most batt of the initial stack accumulated at the bottom of the shaft 50. This is illustrated in FIG. 12. As descent of platen 30 continues, the batts of the initial stack are compressed.

Figure 13:
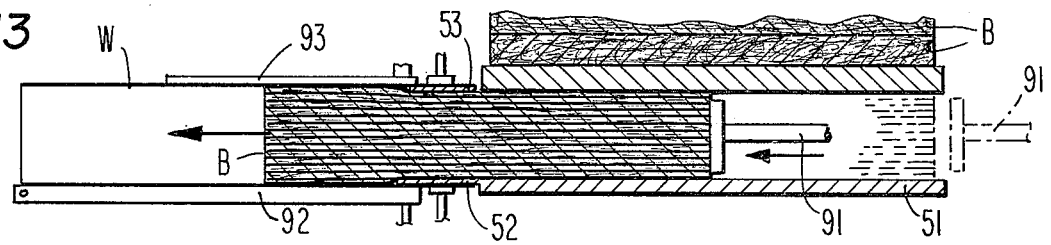
Figure 14:
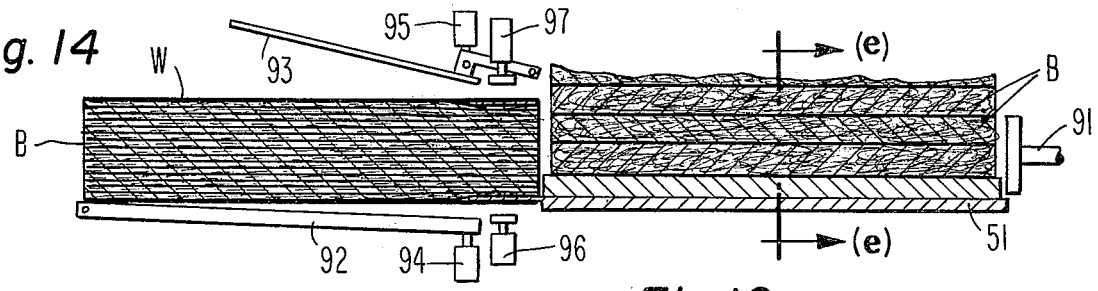

When the stack of batts is fully compressed, as illustrated in FIG. 13, a hydraulic ram 91 is actuated and moves from the phantom position shown in FIG. 13 to and through the solid position, and the stack of compressed batts is pushed laterally outward from vertical shaft 50, on to and beyond apron 52. During this movement, the stack of batts is maintained in compressed condition by a pair of piston-actuated retaining plates 92, 93, as illustrated in FIG. 13. A sleeve wrapper W is manually in position to receive the stack of compressed batts, and is retained in position by a pair of clamps 96 and 97. After the batts are fully within the sleeve wrapper W, the retaining plate 92, 93 are withdrawn pivotally, as illustrated in FIG. 14, and the clamps 96, 97 are also withdrawn to release the wrapper W. The sleeve-wrapped bundle or package is then taken or carried away, as on conveyor, not shown.

Figure 15:
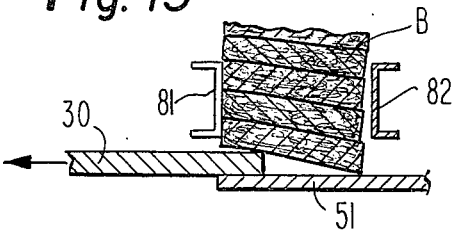

Platen 30, after being lowered all the way to the bottom plate 51 of the shaft 50, to the position illustrated in FIG. 14, is withdrawn laterally from shaft 50. This withdrawal is illustrated schematically in FIG. 15, which is a view looking along the line (*e*)–(*e*) of FIG. 14. Withdrawal of platen 30 is effected by rack gears 36 driven by motor 38. Retaining members 81, 82 retain the batts which had been carried down by platen 30 in stacked alignment during withdrawal of platen 30.

Figure 16:
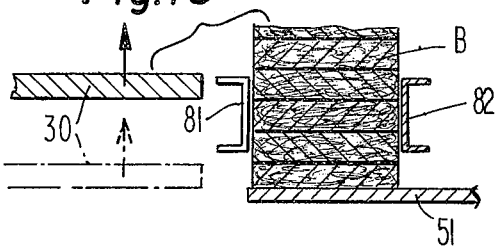

Following withdrawal of platen 30 from the bottom of shaft 50, the motor 42 is actuated to drive the rack gears 45 to lift carriage 20, thereby to lift platen 30, as indicated schematically in FIG. 16.

During that portion of the operation just described, in which the compressed stack of batts is pushed by ram 91 out of the bottom of the shaft 50 into a sleeve wrapper W, and also during the lifting of carriage 20 with platen 30 withdrawn from shaft 50, batts are continuing to be delivered by conveyer C one at a time to the drop gate D. As each batt is delivered, it is sensed and counted by means including photo-cell 100. Each batt is supported momentarily on the pair of bars 74 of gate D, as illustrated in solid line in FIG. 7. The delivery of the batt having been detected by photo-cell 100, the gate D is then opened and the batt is dropped. Batts dropped by the gate D are accumulated in stacked formation on the pair of bars 76 of the closed gate Q after a full count is accumulated in the shaft 50. The carriage 20, prior to this point, will have reached its uppermost position and now the platen 30 is again moved laterally into shaft 50. This is sensed by proximity switch 101, and gate Q opens. The batts accumulated thereon are now dropped onto platen 30. Thereafter, as the platen 30 is lowered, batts are dropped one by one by the opening and closing of the drop gate D. These batts pass through the open queue gate Q and are caught by the descending platen 30. When the predetermined number of batts have been accumulated in cavity 50 as sensed and counted by means including photo-cell 100, the gate Q is caused to close, and thereafter the batts dropped by drop gate D are supported on the bars 76 of gate Q. When the descending platen 30 reaches the uppermost batt of the stack of batts located therebelow in the bottom of shaft 50, as illustrated in FIG. 12, compression of the stack of batts begins and continues until the stack is fully compressed, as in FIG. 13. The cycle described then repeats.

An important feature of the apparatus of this invention is that the platen 30 is advanced at a rate of speed sufficient to compress the material under the platen 30 to the desired degree of compression while additional material is being accumulated in the apparatus.

A certain amount of dwell time is required for removal of the compressed batts from the cavity, withdrawal of the platen 30, and the return and reinsertion of the platen 30. The linear downward rate is therefore more than twice as great as the theoretical amount to provide for the necessary dwell time and recycling of the platen 30. The adjustment of the speed of the platen is obtained by changing the sppeed of the drive motor or others by other means known to those skilled in the art.

The apparatus of the present invention is adapted to handle batts of different widths. This required provision of means for varying the width of shaft 50. When the width of shaft 50 is changed, it is necessary to adjust the actuating mechanism which actuates drop gate D and queue gate Q. Unless this actuating mechanism is adjusted, the pairs of bars 74 and 76 of gates D and Q will not occupy the proper angular positions when the gates are in their open and closed conditions. The means for adjusting the width of shaft 50 and of simultaneously adjusting the actuating mechanism of the drop gate D and queue gate Q will now be described.

In FIG. 2 of the drawing, shaft 50 is illustrated in its most narrow width. To increase the width of shaft 50, the attendant removes a lock pin 59 to release handle bar 60 and then pulls down on the handle bar. He has the choice of pulling handle bar 60 down to a first position 57 or to a second position 58. Pulling handle bar 60 down to first position 57 widens chamber 50 to an intermediate width. Pulling handle bar 60 down to second position 58, widens shaft 50 to its widest condition.

When handle bar 60 is pulled downwardly, a parallel linkage 77, which is connected by a vertical tube 61, pivots about fulcrum points 78 located in the fexed posts 54 of the frame. This causes the pair of movable posts 55 and the plate 82 to move outwardly on rollers 56, to the right as viewed in FIGS. 2 and 4. In this action, rollers 56 ride on bottom plate 51 of shaft 50. Vertical tube 61 moves outwardly and downwardly.

Reference is now made to FIG. 5, which is a detailed view looking along the line 5—5 of FIG. 2. When tube 61 moves outwardly and downwardly, the tube slides in a guide bushing 70 which is fixed to a C-shaped plate 69 which cannot move downwardly. Plate 69 is suspended at the lower end of a pair of rods 64. These rods 64 extend downwardly from fixed brackets 65 in the fixed post 54 and movable post 55. The lower ends of rods 64 are pivotally connected to a pin 71 fixed to the C-plate 69. Thus, plate 69 is suspended by arms 64 and is free to move laterally, but not downwardly.

Secured to plate 69 is a cylinder 68 whose piston controls the movement of a pair of arms 66 which are connected to, and control the opening and closing of, queue gate Q.

As seen in FIG. 3, a duplicate mechanism similar to that shown in FIG. 5 and described above is provided on the opposite side of the shaft 50 for controlling the opening and closing of drop gate D. Similar components are identified by similar reference numerals to which 100 has been added. For example, C-plate 69 on one side and C-plate 169 on the other; cylinder 68 on one side and cylinder 168 on the other; arms 66 on one side and arms 166 on the other. The operation of the mechanisms are similar, and it will not be necessary to describe each separately.

It will be seen that when handle bar 60 is pulled down by the attendant to change the width of shaft 50, the C-plate 69 and 169, and the piston cylinders 68 and 168 secured thereto, move laterally but are prevented from moving downwardly by the rods 64. Actually, the C-plates 69, 169 and the piston cylinders 68, 168, move slightly upwardly as the angle of rods 64 widens. This action maintains the proper angular positions for bars 74 and 76 of drop gate D and queue gate Q, respectively, in the open and closed positions of the gates. When handle bar 60 is pulled upwardly from positions 58 and 57 to narrow the shaft 50, the C-plates 69, 169 move slightly downwardly as the angle of rods 64 narrows.

Reference is now made to FIG. 6 which is a view looking down along the line 6—6 of FIG. 2. Reference is also made to FIG. 1. FIG. 6 indicates the construction of one of the two opposite sidewalls of the shaft 50. Secured to the fixed post 54, on each side of shaft 50, is a fixed sidewall member 154. Secured to movable post 55, on each side of the shaft, is a sidewall member 155. Sidewall member 154 and 155 occupy parallel overlapping positions, as seen in FIG. 6. Thus, when handle bar 60 is pulled down to increase the width of shaft 50, and parallel linkage 77 operates to move the movable posts 55 outwardly, in the direction of the arrow in FIG. 6, the sidewall members 155 move slidingly outwardly relative to the fixed sidewall member 154. The positions of sidewall members 154 and 155, relative to the other components of the apparatus, are clearly seen in FIG. 1.

REference is again made to FIG. 2 and 3. As seen in FIG. 3, the outward wall end of vertical shaft 50 is open except for a plurality of vertical posts 85 which function to contain and guide the batts as they drop or are carried down the shaft 50. At the bottom of shaft 50, a plate 82 extends across the length of the shaft and is secured to the movable posts 55. Opposed to plate 82 are a pair of short plates 81 which extend from fixed posts 54 toward the center of the shaft 50 leaving a gap therebetween through which the leg of the T-shaped carriage 20 passes.

FIGS. 1, 2 and 3 show the manner in which the pivotal retaining plates 92 and 93 are supported. A cross bar 86 is supported by a pair of posts 87. The upper retaining plate 93 is moved pivotally by piston cylinder 95 which is supported on cross bar 86. The lower retaining plate 92 is moved pivotally by piston cylinder 94 which is supported on a lower frame member.

Without intending to be limited to specific dimensions, it may be said that apparatus according to the present invention, as illustrated and described herein, has been constructed and used, It is mounted on casters 11 so that it may be readily pushed into position at the end of any conveyer C. The constructed apparatus has an overall width of the order of 6½ feet and a height of the order of 13 feet.

The batts B which are delivered from conveyor C to the automatic batt stacker/loader of the present invention are delivered to the conveyor directly from the equipment which produces the batts. It has been indicated that batts of different widths may be delivered to the batt stacker/loader and that the apparatus is adjustable to handle batts of different widths. It should be mentioned that batts of different thicknesses are manufactured and delivered to the conveyor C. The stacker/loader of the present invention is adapted to receive and handle batts of different thicknesses without adjustment. The input conveyor runs at a constant speed, this speed being adequate to deliver a batt fully out upon the drop gates. Although the line delivering changes its speed inversely with batt thickness, the input conveyor speed receiving batts from the line conveyor operates at a constant speed. This speed is adequate to impart enough momentum to all thicknesses and classes of batts to ensure their complete projection upon the drop gates.

Once upon the drop gates, the drop gate opening is delayed until all residual energy in the batts is dissipated. Thus, each batt when dropped has no remaining angular momentum. By this means, flat drops are assured.

Also, the drop gate, by its design, does not impart angular momentum, since the two rods 74 and 76 are equi-distanct from their center of rotation and linked. Thus, their linear velocities are equal, as well as the angular velocity.

Thicker batts are delivered by the manufacturing equipment to the input conveyor at a proportionally slower rate than are the thinner batts. As a result, it is not necessary to alter the speed of the input conveyor, nor to adjust the stacker/loader, when the batt-producing apparatus is changed to produce thicker or thinner batts. The time required for platen 30 of the stacker/loader to move downwardly and upwardly is coordinated with the rate of delivery of batts to the apparatus, so the desired number of batts is delivered to, and accumulated on, the gate Q and descending platen 30 during each cycle.

The stacker/loader of the present application can be operated fully automatically as illustrated except for the manual labor required to place the sleeve wrappers W in position to receive the compressed stacks of batts as they are pushed out of the bottom of shaft 50 by ram 91. A supply of such sleeve wrappers may conveniently be provided on the shelf, which projects outwardly, to the left as viewed in FIG. 3, below to retaining plate 92. It should be noted, however, that the placement of the sleeve can be automated if desired.

What is claimed is:

1. Apparatus for stacking batts of compressible material, said apparatus comprising:

a. a main frame having a hollow rectangular shaft extending from top to bottom of said frame;

b. a carriage;

c. means supporting said carriage for vertical movement on said frame;

d. a platen supported for lateral movement in said carriage;

e. means for moving said platen laterally on extend said platen across said hollow shaft and to withdraw said platen from said shaft;

f. means for moving said carriage downwardly when said platen extends across said shaft and for moving said carriage upwardly when said platen has been withdrawn from said shaft;

g. means for delivering batts of compressible material to the upper end of said hollow shaft;

h. drop-gate means in said shaft near the upper end thereof for supporting a delivered batt when said drop-gate means is in closed position;

i. means for opening said drop gate means in response to delivery of a batt thereonto and for thereafter closing said drop gate means;

j. queue-gate means in said shaft near the upper end thereof spaced below said drop-gate means for supporting, when said queue-gate means is closed, one or more batts in stacked arrangment;

k. means for opening and closing said queue-gate means;

l. said queue-gate means, when opened, being adapted at start-up to drop said batts to the bottom of said shaft and being adapted when said platen extends across shaft to drop batts onto said platen m. said platen, when extended across said shaft, being adapted when said carriage is lowered to compress a stack of batts in said shaft therebeneath.

2. Apparatus according to claim 1 wherein said platen is adapted to advance downwardly at a linear rate greater than the rate of linear thickness accumulation of the batts received by said apparatus.

3. Apparatus according to claim 1 including:

a. ram means adjacent the bottom to said shaft for pushing a compressed stack of batts laterally out of said shaft; and b. means adjacent the bottom of said shaft for receiving a compressed stack of batts.

4. Apparatus acccording to claim 1 wherein:

a. said means for opening and closing said drop gate means includes means for sensing that a batt has been delivered to said drop gate means.

5. Apparatus according to claim 1 wherein:

a. said drop-gate means and said queue-gate means each includes a pair of parallel bars, each bar pivotal into inward and outward positions.

6. Apparatus according to claim 3 wherein:

a. said drop-gate means and said queue-gate means each includes a pair of parallel bars, each bar pivotal into inward and outward positions.

7. Apparatus according to claim 1 wherein said means for moving said carriage downwardly and upwardly includes:

a. vertical rack means;

b. vertical rack gear means;

c. a lift and descent motor supported in said carriage for driving said rack gear means.

8. Apparatus according to claim 7 including:

a. roller guide means for said carriage.

9. Apparatus according to claim 1 wherein said means for moving said platen laterally includes:

a. lateral rack means secured to said platen;

b. later rack gear means;

c. a motor supported in said carriage for driving said lateral rack gear means.

10. Apparatus according to claim 9 including:

a. roller guide means for said platen;

11. Apparatus according to claim 7 wherein said means for moving said platen laterally includes:

a. lateral rack means secured to said platen;

b. lateral rack gear means;

c. a motor supported in said carriage for driving said lateral rack gear means.

12. Apparatus according to claim 1 wherein:

a. means are provided for adjusting the width of said hollow shaft to accomodate for batts of different widths.

13. Apparatus according to claim 11 wherein:

a. means are provided for adjusting the width of said hollow shaft to accomodate for batts of different widths.

14. Apparatus according to claim 12 wherein:

a. means for adjusting the width of said shaft includes means for also adjusting the means for opening and closing said drop-gate means and said queue-gate means.

15. Apparatus according to claim 13 wherein:

a. said means for adjusting the width of said shaft includes means for also adjusting the means for opening and closing said drop-gate means and said queue-gate means.

16. Apparatus according to claim 12 wherein:

a. said hollow shaft includes a pair of fixed corner posts and a pair of movable corner posts.

17. Apparatus according to claim 16 wherein:

a. said means for adjusting width of said hollow shaft includes a pair of parallel linkages manually operated.

18. Apparatus according to claim 14 wherein said means for adjusting the means for opening and closing said drop-gate means and said queue-gate means includes:

a. cylinder means;

b. rod means connecting said cylinder means to said gate means;

c. support means for supporting said cylinder means to allow lateral movement but not descending movement of the cylinder.

* * * * *